US007507517B2

(12) United States Patent
Wolfe et al.

(10) Patent No.: US 7,507,517 B2
(45) Date of Patent: Mar. 24, 2009

(54) TONER PROCESSES

(75) Inventors: Christopher M. Wolfe, Webster, NY (US); Mark A. Jackson, Rochester, NY (US); Chieh-Min Cheng, Rochester, NY (US); Emily L. Moore, Mississauga (CA); Louis V. Isganitis, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 491 days.

(21) Appl. No.: 11/247,565

(22) Filed: Oct. 11, 2005

(65) Prior Publication Data

US 2007/0082287 A1 Apr. 12, 2007

(51) Int. Cl.
*G03G 9/08* (2006.01)

(52) U.S. Cl. ..... 430/137.14; 430/105

(58) Field of Classification Search ..... 430/137.14, 430/105

See application file for complete search history.

(56) References Cited

U.S. PATENT DOCUMENTS 3,590,000 A 6/1971 Palermiti et al.
3,655,374 A 4/1972 Palermiti et al.
3,720,617 A 3/1973 Chatterji et al.
3,944,493 A 3/1976 Jadwin et al.
3,983,045 A 9/1976 Jugle et al.
4,007,293 A 2/1977 Mincer et al.
4,079,014 A 3/1978 Burness et al.
4,265,990 A 5/1981 Stolka et al.
4,394,430 A 7/1983 Jadwin et al.
4,560,635 A 12/1985 Hoffend et al.
4,563,408 A 1/1986 Lin et al.
4,584,253 A 4/1986 Lin et al.
4,858,884 A 8/1989 Harwath et al.
4,935,326 A 6/1990 Creatura et al.
4,937,166 A 6/1990 Creatura et al.
5,227,460 A 7/1993 Mahabadi et al.
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,853,943 A * 12/1998 Cheng et al. ..... 430/137.17

(Continued)

OTHER PUBLICATIONS

Jachuck et al., "Process Intensification: The Opportunity Presented by Spinning Disc Reactor Technology," Inst. Chem. Eng. Symp. Ser. 1997, vol. 141, pp. 417-424.

*Primary Examiner*—John L Goodrow
(74) *Attorney, Agent, or Firm*—Carter, DeLuca, Farrell & Schmidt, LLP

(57) ABSTRACT

Continuous processes for producing toner compositions are provided utilizing spinning disc reactors, rotating tubular reactors, or combinations thereof.

14 Claims, 4 Drawing Sheets

U.S. PATENT DOCUMENTS 6,004,714 A 12/1999 Ciccarelli et al.
6,054,240 A * 4/2000 Julien et al. ..... 430/109.3
6,190,815 B1 2/2001 Ciccarelli et al.
6,500,596 B2 * 12/2002 Tanabe et al. ..... 430/137.14
2007/0007677 A1 * 1/2007 Blair et al. ..... 264/8

* cited by examiner

TONER PROCESSES

BACKGROUND

This disclosure relates to processes for preparing toner compositions. More specifically, continuous processes for aggregating and coalescing toner are described.

Processes for forming toner compositions for use with electrostatographic, electrophotographic, or xerographic print or copy devices have been previously disclosed. For example, toners can be prepared by a process that involves emulsion preparation of a latex, followed by aggregation and coalescence of the emulsion with a colorant, washing the resulting product and then isolating the toner.

Methods of preparing an emulsion aggregation (EA) type toner are known and toners may be formed by aggregating a colorant with a latex polymer formed by batch or semi-continuous emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, 5,346,797, and U.S. patent application Ser. No. 11/155,452 filed on Jun. 17, 2005 entitled "Toner Processes", the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

As noted above, latex polymers utilized in the formation of EA type toners may be formed by batch or semi-continuous emulsion polymerization processes. Where a batch process is utilized in forming toner, because the individual batch process involves the handling of bulk amounts of material, each process takes many hours to complete before moving to the next process in the formation of the EA toner, that is, aggregation and/or coalescence. In addition, batch-to-batch consistency is frequently difficult to achieve because of variations that may arise from one batch to another.

Spinning disc reactors (SDR) are known. The spinning disc concept is an attempt to apply process intensification methods within the fields of heat and mass transfer. The technology was developed for typical heat and mass transfer operations such as heat exchanging, heating, cooling, mixing, blending and the like, for example, as disclosed by Jachuck et al., "Process Intensification: The Opportunity Presented by Spinning Disc Reactor Technology," Inst. Chem. Eng. Symp. Ser. 1997, Vol. 141, pp. 417-424. The technology operates by the use of high gravity fields created by rotation of a disc surface causing fluid introduced to the disc surface at its axis to flow radially outward under the influence of centrifugal acceleration in the form of thin, often wavy, films. Such thin films exhibit excellent heat and mass transfer rates.

It would be advantageous to provide a process for the preparation of a toner product that is more efficient, takes less time, and results in a consistent toner product.

SUMMARY

The present disclosure provides processes for continuously producing toner in a reaction system. The reaction system can include a spinning disc reactor, a rotating tubular reactor or combinations thereof. The process includes continuously aggregating a colorant and latex emulsion in an aggregation component of the reaction system to form aggregated toner particles, continuously coalescing the aggregated toner particles in a coalescence component of the reaction system to form aggregated and coalesced toner particles, and collecting the aggregated and coalesced toner particles from the reaction system.

The present disclosure also provides a reaction system including a first reactor for continuously aggregating a colorant and a latex emulsion to form aggregated toner particles, and a second reactor for continuously coalescing said aggregated toner particles to form aggregated and coalesced toner particles. The reactors can include spinning disc reactors, rotating tubular reactors, or combinations thereof.

Processes for continuously producing toner in a reaction system are also provided. The process includes continuously aggregating a colorant selected from the group consisting of black pigments, cyan pigments, magenta pigments, red pigments, brown pigments, orange pigments yellow pigments, and mixtures thereof and a latex emulsion comprising latex particles selected from the group consisting of styrenes, acrylates, methacrylates, butadienes, isoprenes, acrylic acids, methacrylic acids, acrylonitriles, and optionally mixtures thereof in a first reactor which can include a spinning disc reactor at a temperature from about 35° C. to about 75° C. and a pH from about 3.5 to about 7 to form aggregated toner particles. The aggregated toner particles are continuously coalesced in a second reactor which can include a rotating tubular reactor at a temperature from about 80° C. to about 100° C. and a pH from about 3 to about 7 to form aggregated and coalesced toner particles having a diameter from about 1 micron to about 20 microns. In embodiments, the process can optionally include cooling the aggregated and coalesced toner particles to a temperature from about 60° C. to about 20° C. and collecting the aggregated and coalesced toner particles from the reaction system.

BRIEF DESCRIPTION OF THE DRAWINGS

Various embodiments of the present disclosure will be described herein below with reference to the figures wherein.

DETAILED DESCRIPTION OF EMBODIMENTS

Processes for making toner compositions in accordance with this disclosure include a continuous aggregation/coalescence process (schematically illustrated in FIGS. 1, 2 and/or 3) to provide a toner composition. Spinning disc reactors (SDRs), rotating tubular reactors (RTRs), or a combination thereof may be utilized in these processes to aggregate and/or coalesce toner particles.

In embodiments, the toners may be prepared by the aggregation and fusion of latex resin particles with a colorant, and optionally at least one additive such as a surfactant, coagulant, wax and optionally mixtures thereof. "At least one" may refer in embodiments, for example, to from about 1 to about 10, in embodiments from about 2 to about 10, in embodiments from about 2 to about 6.

In embodiments, the raw materials utilized in the processes of the present disclosure, such as deionized water (DIW), latex, pigment, wax, and coagulant, if any, may be first mixed in a stirred vessel such as a mixing tank or any similar stirred tank. The resulting mixture may then be passed through a homogenizer to achieve the desired level of dispersive mixing prior to aggregation and coalescence.

Figure 1:
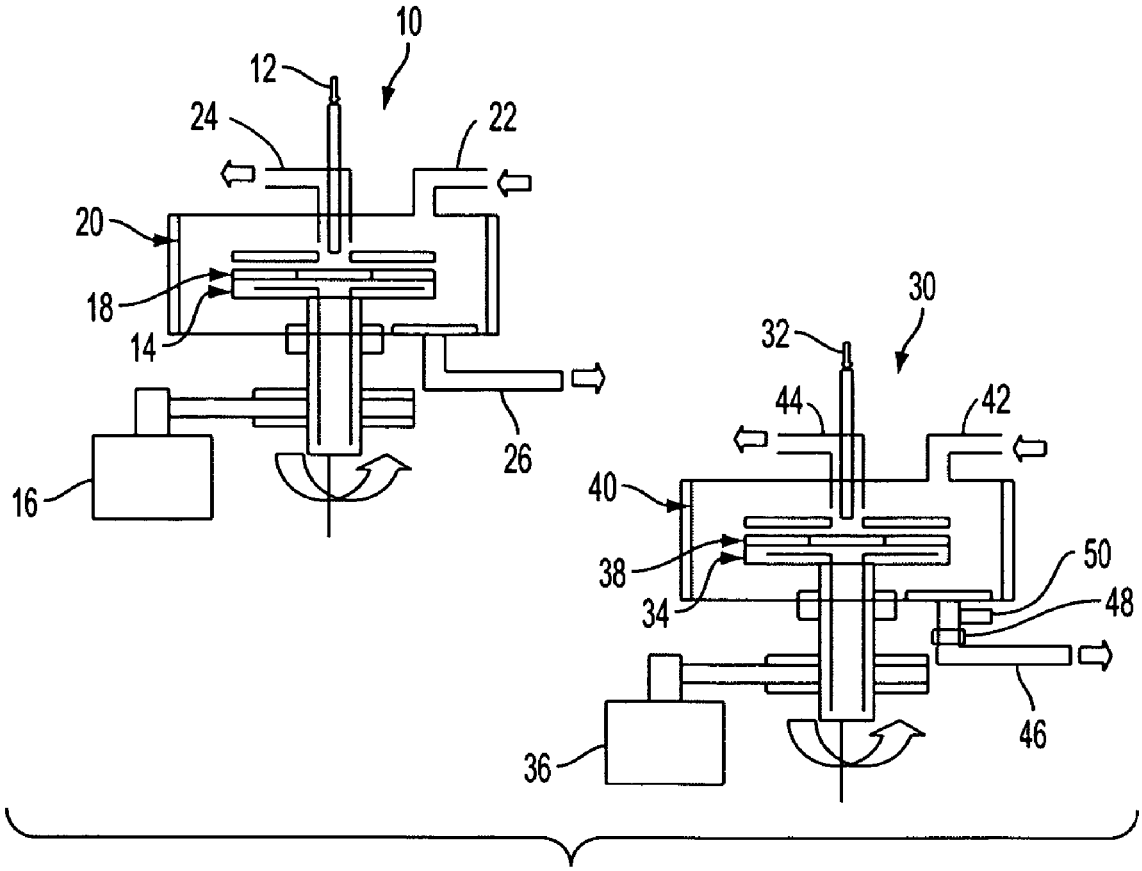
FIG. 1 schematically shows an apparatus suitable for use in connection with a continuous aggregation/coalescence process in accordance with embodiments of the present disclosure.

Turning to FIG. 1, once formed, the homogenized raw material mixture to produce a toner in accordance with the present disclosure or, in embodiments, the individual raw materials themselves, may be fed into inlet port 12 of spinning disc reactor 10. Disc 14 is rotated by means of an air-driven motor 16 at rotational speeds of up to about 15,000 rpm, in embodiments from about 800 rpm to about 15,000 rpm. The top end of the SDR 10 may be connected to a condenser (not shown) and an inert gas such as nitrogen may flow into the reaction system through an inert gas inlet port 22 to prevent oxidation and side reactions and exit through inert gas outlet port 24.

A thin liquid film 18 is formed on the surface of disc 14 where it experiences very high shear stress of about 10 Pascal to about 10,000 Pascal, in embodiments about 50 Pascal to about 5000 Pascal. This high shear stress results in high heat transfer rates of about 1 $kW/m^2K$ to about 20 $kW/m^2K$, in embodiments about 5 $kW/m^2K$ to about 10 $kW/m^2K$ and high mass transfer rates of about 2 mole/second to about $20\times10^4$ mole/second, in embodiments about 3 mole/second to about $15\times10^4$ mole/second between the film and disc and the liquid reagent streams, respectively.

Figure 4:
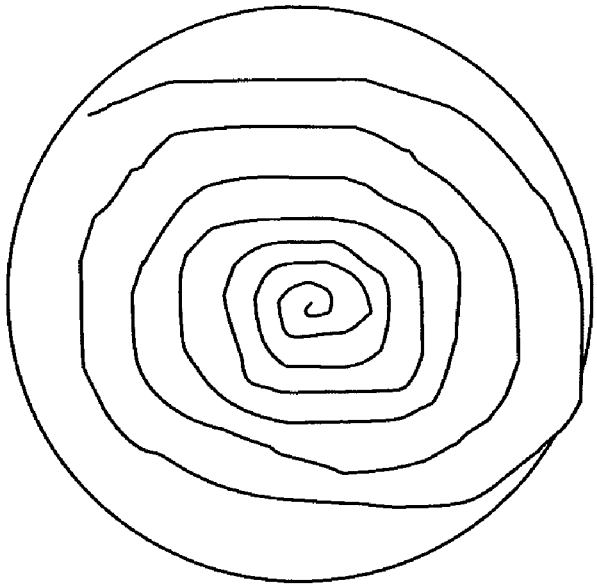
FIG. 4 shows the path of a particle on the surface of a spinning disc reactor utilized in the processes of the present disclosure.
Figure 5:
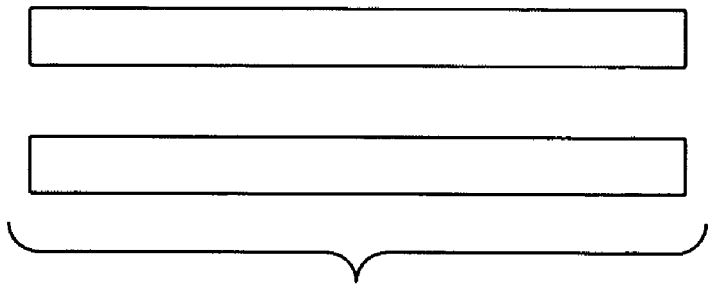
FIG. 5 schematically shows a design for grooves found on the surface of a spinning disc reactor (SDR) or the surface of the inner wall of a rotating tubular reactor (RTR)
Figure 6:
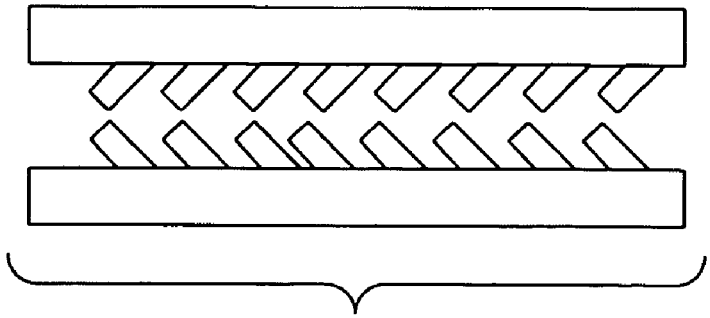
FIG. 6 schematically shows a high shear design for grooves found on the surface of a spinning disc reactor (SDR) or the surface of the inner wall of a rotating tubular reactor (RTR).

The rotor surface of the disc 14 may be grooved to further enhance mixing by forming numerous surface ripples on the thin film. While discs of the SDR may include grooves which are smooth as depicted in FIG. 5 (FIG. 5 is the top view of a groove on the surface of a disc of an SDR or the inner wall of an RTR) and thus result in low shear, in embodiments the grooves on the disc of an SDR can be designed as a rotor-stator type as depicted in FIG. 6 to further enhance the mixing and shear stress (FIG. 6 is the top view of a high shear rotor-stator groove on the surface of a disc of an SDR or the inner wall of an RTR). Other designs can be utilized to allow for custom shear profiles. FIG. 4 depicts the path a particle forming on the SDR would take on the surface of the spinning disc.

The temperature of SDR 10 should be from about 35° C. to about 75° C., in embodiments from about 45° C. to about 65° C., which can be controlled by a heat transfer fluid in the temperature control jacket 20 of the SDR. Particle growth may be influenced by temperature, shear rate, and residence time on the disc. In practice, a residence time in SDR 10 may be from about 0.1 seconds to about 5 seconds, in embodiments from about 1 second to about 3 seconds.

The desired residence time on the disc can be achieved through the SDR reactor design, including the diameter of the spinning disc and the configuration of any grooves thereon (as depicted in FIGS. 5 and 6), and the operation conditions of the SDR, for example the liquid reagent feed rate and the disc spinning speed. Suitable diameters of the spinning disc(s) of an SDR utilized in accordance with the present disclosure may be from about 8 centimeters to about 50 centimeters, in embodiments from about 15 centimeters to about 30 centimeters. The spinning speed of disc(s) of an SDR utilized in accordance with the present disclosure may be from about 800 rpm to about 15,000 rpm, in embodiments from about 5000 rpm to about 10,000 rpm.

The process materials leave SDR 10 via drainpipe 26. These process materials may then be transferred into another SDR 30 for further raw material addition and particle growth and aggregation.

SDR 30 may be configured as SDR 10, that is, it may possess spinning disc 34, motor 36, temperature control jacket 40, inert gas inlet port 42, inert gas outlet port 44, and drain pipe 46. Additional reactant may optionally be added through supply port 32 for introduction into SDR 30.

As shown in FIG. 1, in embodiments a second aggregation phase may be utilized to provide a core/shell structure to the particles. The particle slurry from the first SDR 10 may be introduced into the feed port 32 of SDR 30 along with a shell latex, which may be the same or different as the latex utilized to form the particle in the first phase of aggregation in SDR 10. As in SDR 10, the temperature of the second phase of aggregation may be from about 35° C. to about 75° C., in embodiments from about 45° C. to about 65° C., which can be controlled by a heat transfer fluid in the temperature control jacket 40 of SDR 30. In practice, a residence time in SDR 30 may be from about 0.1 seconds to about 5 seconds, in embodiments from about 1 second to about 3 seconds.

Particle growth of toner 38 on the surface of disc 34 in the second SDR 30 may also be influenced by temperature, shear rate, and residence time on the disc. The desired residence time on the disc can be achieved through the SDR reactor design, including the diameter of the spinning disc and the configuration of any grooves thereon (as depicted in FIGS. 5 and 6), and the operation conditions of the SDR, for example the liquid reagent feed rate and the disc spinning speed. As with SDR 10, suitable diameters of the spinning disc(s) of an SDR utilized in accordance with the present disclosure may be from about 8 centimeters to about 50 centimeters, in embodiments from about 15 centimeters to about 30 centimeters. The spinning speed of disc(s) of an SDR utilized in accordance with the present disclosure may be from about 800 rpm to about 15,000 rpm, in embodiments from about 5000 rpm to about 10,000 rpm.

The resulting particle slurry is discharged from SDR 30 by drain pipe 46. Upon discharge, the slurry may be blended with a base, such as sodium hydroxide, potassium hydroxide, cesium hydroxide, calcium hydroxide, any other alkaline base, or combinations thereof introduced through inlet port 50 to terminate particle growth. An inline pH meter 48 may be utilized to monitor the pH of the slurry to ensure that the correct rate of base addition is taking place.

Toner particles produced by an SDR system in accordance with the present disclosure may have a size of about 1 micron to about 20 microns, in embodiments about 3 microns to about 15 microns.

Figure 2:
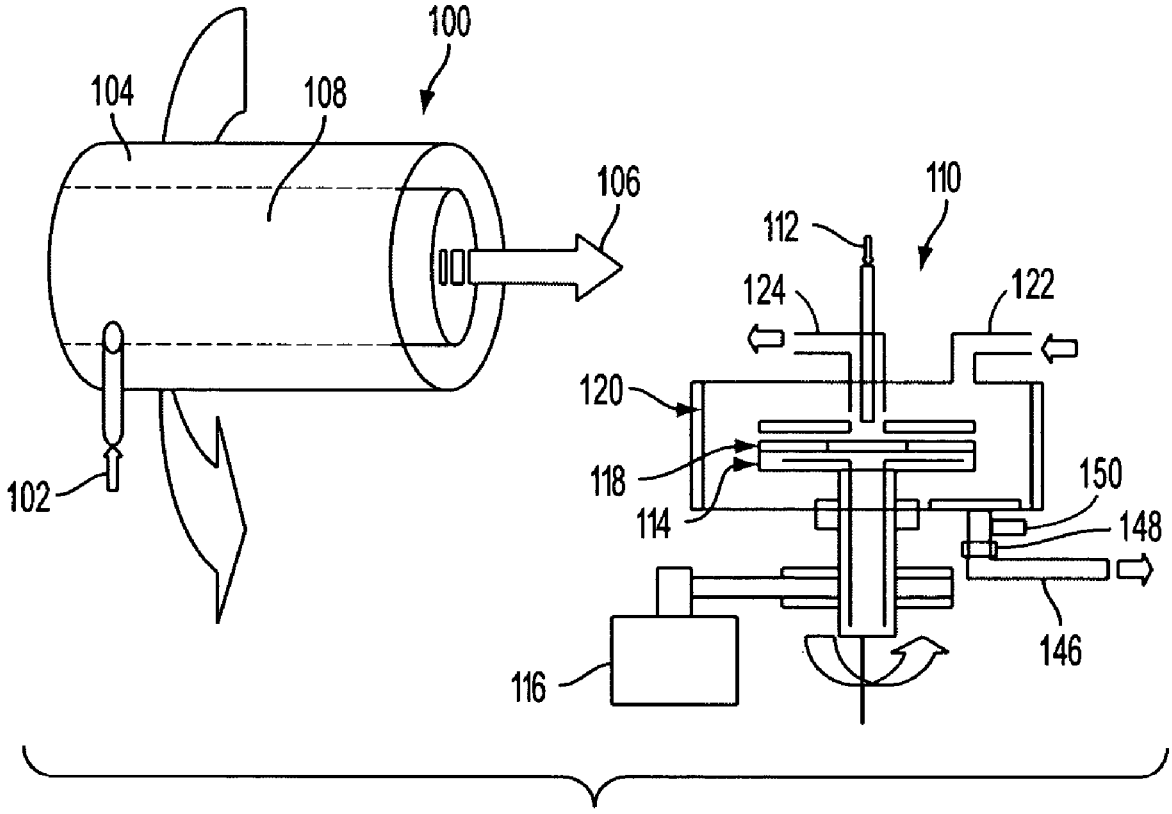
FIG. 2 schematically shows an alternate apparatus suitable for use in connection with a continuous aggregation/coalescence process in accordance with embodiments of the present disclosure.

In other embodiments, as depicted in FIG. 2, a homogenized raw material mixture of deionized water (DMW), latex, pigment, wax and coagulant, if any, may be fed into the inlet port 102 of a first rotating tubular reactor 100 for aggregation, followed by introduction into an SDR 110 for additional aggregation. Tube 108 may be rotated by means of an air-driven motor (not shown) at rotational speeds of up to about 15,000 rpm, in embodiments from about 5000 rpm to about 10,000 rpm. A thin liquid film is formed on the tubular reactor wall, where it experiences very high shear stress of about 10 Pascal to about 10,000 Pascal, in embodiments about 50 Pascal to about 5000 Pascal.

Shear rate can be adjusted through different groove designs on the interior surface of tube 108 of RTR 100. FIG. 5 depicts a low shear design and FIG. 6 depicts a higher shear design. Other designs can be made to allow for custom shear profiles. These configurations, especially the rotor-stator type depicted in FIG. 6, can produce very high heat transfer rates of about 1 $kW/m^2K$ to about 20 $kW/m^2K$, in embodiments about 5 $kW/m^2$ K to about 10 $kW/m^2K$ and high mass transfer rates of about 2 mole/second to about $20\times10^4$ mole/second, in embodiments about 3 mole/second to about $15\times10^4$ mole/second between the film and tube wall and the liquid reagent streams, respectively. These configurations also further enhance mixing by forming numerous surface ripples on the thin film.

Particle growth in this first phase of aggregation may be controlled by the tube temperature, the shear rate, and the residence time on the inner wall of tube 108. The temperature of the RTR may be from about 35° C. to about 75° C., in embodiments from about 45° C. to about 65° C. The temperature may be controlled by a heat transfer fluid in the temperature control jacket 104 of the RTR.

The desired residence time can be achieved through the RTR reactor design, including the diameter and length of the RTR and groove channels on the interior surface of the RTR, and operation conditions, including the liquid feed rate and the tube spinning speed. Suitable tube lengths for RTR(s) utilized in accordance with the present disclosure may be from about 1 meter to about 5 meters, in embodiments from about 1.5 meters to about 2.5 meters. Suitable inner diameters of a tube of an RTR may be from about 8 centimeters to about 50 centimeters, in embodiments from about 15 centimeters to about 30 centimeters. The spinning speed of the tube(s) of an RTR utilized in accordance with the present disclosure may be from about 800 rpm to about 15,000 rpm, in embodiments from about 5000 rpm to about 10,000 rpm. The RTR should be designed to provide local residence times of from about 0.1 seconds to about 10 seconds in the RTR, in embodiments from about 1 second to about 5 seconds in the RTR.

The process materials leave the RTR through outlet port 106 and travel to SDR 110 for a second aggregation phase. As depicted in FIG. 2, a second aggregation phase may be utilized to provide a core/shell structure to the particles. The particle slurry from the first phase of aggregation in the RTR 100 may be introduced into supply port 112 of SDR 110 along with a shell latex, which may be the same or different as the latex utilized to form the particle in the first phase of aggregation in RTR 100.

Particle growth in SDR 110 may also be influenced by temperature, shear rate, and residence time on the disc. The desired residence time on the disc can be achieved through the SDR reactor design, including the diameter of the spinning disc and the configuration of any grooves thereon (as depicted in FIGS. 5 and 6), and the operation conditions of the SDR, for example the liquid reagent feed rate and the disc spinning speed. Suitable diameters of the spinning disc(s) of an SDR utilized in accordance with the present disclosure may be from about 8 centimeters to about 50 centimeters, in embodiments from about 15 centimeters to about 30 centimeters. The spinning speed of disc(s) of an SDR utilized in accordance with the present disclosure may be from about 800 rpm to about 15,000 rpm, in embodiments from about 5000 rpm to about 10,000 rpm.

As in the first phase of aggregation in 100, particle growth in the second phase of aggregation in SDR 110 may be at a temperature from about 35° C. to about 75° C., in embodiments from about 45° C. to about 65° C., which can be controlled by a heat transfer fluid in the temperature control jacket 120 of SDR 110. In practice, a residence time on the disc from about 0.1 seconds to about 10 seconds seconds, in embodiments from about 1 second to about 5 seconds, may be achievable.

As the particle slurry is discharged from the disc it may be blended with a base solution introduced through inlet 146 to terminate particle growth. Suitable bases which may be utilized include, but are not limited to, sodium hydroxide, potassium hydroxide, cesium hydroxide, calcium hydroxide, any other alkaline base, or combinations thereof. An inline pH meter 144 can be utilized to provide feedback to ensure that the correct amount of base is being added to the slurry. A suitable pH may be from about 3.5 to about 7.0, in embodiments from about 4.5 to about 6.0.

While FIG. 2 depicts an RTR as phase 1 of aggregation followed by an SDR for phase 2 of aggregation, it is within the purview of one skilled in the art to alter the configuration of such a system to produce a toner in accordance with the processes of the present disclosure. For example, in embodiments, the first phase of aggregation may be conducted in an SDR followed by a second phase of aggregation in an RTR, or both phases of aggregation may be conducted in an RTR (or an SDR system as depicted in FIG. 1 may be utilized).

Toner particles produced in an RTR/SDR system in accordance with the present disclosure may have a size from about 1 micron to about 20 microns, in embodiments from about 3 microns to about 15 microns.

Figure 3:
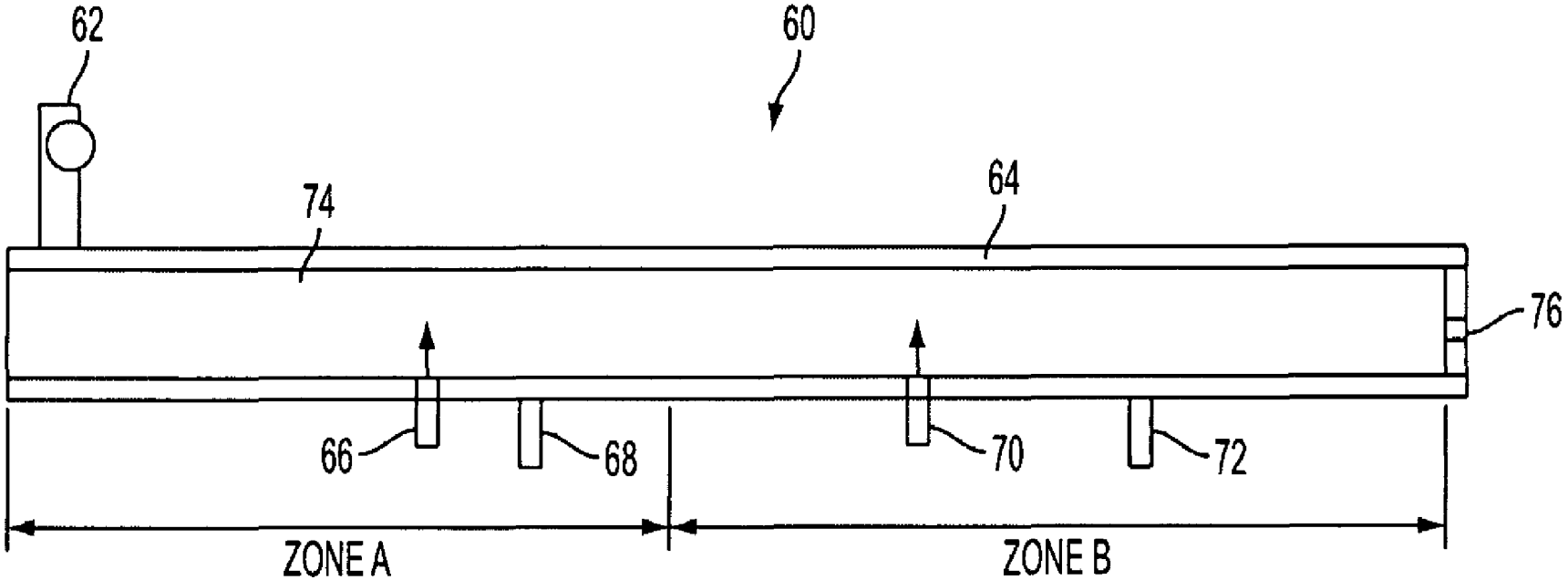
FIG. 3 schematically shows an alternate apparatus suitable for use in connection with a continuous aggregation/coalescence process in accordance with embodiments of the present disclosure.

As shown in FIG. 3, the slurry discharged from the aggregation SDR(s) of FIG. 1 or the aggregation RTR/SDR of FIG. 2 may then be introduced into tube 74 of RTR 60 via supply port 62 so that the particle aggregates may be coalesced in Zone A to the desired shape. Suitable shapes can be popcorn like particles having irregular surfaces to perfect spheres.

Tube 74 of RTR 60 may be rotated by means of an air-driven motor (not shown) at rotational speeds up to about 15,000 rpm, in embodiments from about 5000 rpm to about 10,000 rpm. As described above, a thin liquid film forms on the tubular reactor wall, where it experiences very high shear stress of about 10 Pascal to about 10,000 Pascal, in embodiments about 50 Pascal to about 5000 Pascal.

As noted above, shear rate can be adjusted through different groove designs on the interior surface of tube 74 of RTR 60, including the low shear design of FIG. 5 and the high shear rotor-stator design of FIG. 6. As noted above, these grooves can produce very high heat transfer rates of about 1 $kW/m^2K$ to about 20 $kW/m^2K$, in embodiments about 5 $kW/m^2K$ to about 10 $kW/m^2K$ and high mass transfer rates of about 2 mole/second to about $20\times10^4$ mole/second, in embodiments about 3 mole/second to about $15\times10^4$ mole/second between the film and tube wall and the liquid reagent streams, respectively. These configurations also further enhance mixing by forming numerous surface ripples on the thin film.

The shape of the particles may be adjusted by the temperature of the tubular reactor, the pH of the particle slurry, and the residence time of the slurry in the RTR. The temperature of the RTR may be from about 80° C. to about 100° C., in embodiments from about 93° C. to about 97° C. The temperature may be controlled by a heat transfer fluid in the temperature control jacket 64 of the RTR.

The pH of the slurry may be adjusted through the addition of acid or base solutions through inlet port 66. Suitable acid solutions include, for example, nitric acid, hydrochloric acid, sulfuric acid, perchloric acid, chloric acid, combinations thereof, and derivatives thereof, while suitable base solutions include, for example, sodium hydroxide, potassium hydroxide, cesium hydroxide, calcium hydroxide, or any other alkaline base or combinations thereof. An inline pH meter 68 provides feedback to ensure that the correct rate of addition of acid or base is taking place. Suitable pH for the slurry can be from about 3 to about 7, in embodiments from about 4 to about 6.

The desired residence time can be achieved through the RTR reactor design, including the diameter and length of the RTR and the configuration of grooves on the interior surface of the RTR, and operation conditions, including the liquid feed rate and the tube spinning speed. Suitable tube lengths for RTR(s) utilized for coalescence in accordance with the present disclosure may be from about 1 meter to about 5 meters, in embodiments from about 1.5 meters to about 2.5 meters. Suitable inner diameters of a tube of an RTR utilized for coalescence may be from about 8 centimeters to about 50 centimeters, in embodiments from about 15 centimeters to about 30 centimeters. The spinning speed of the tube(s) of an RTR utilized for coalescence in accordance with the present disclosure may be from about 800 rpm to about 15,000 rpm, in embodiments from about 5000 rpm to about 10,000 rpm. The RTR utilized for coalescence should be designed to provide local residence times of from about 0.1 seconds to about 10 seconds in the RTR, in embodiments from about 1 second to about 5 seconds in the RTR.

Termination of coalescence occurs as the particle slurry proceeds into the cooling portion, Zone B, of the RTR. The rate of cooling may be adjusted to ensure the proper surface properties of the particles. The cooling rate may be adjusted through the temperature control jacket 64 and the length of tube 74. In embodiments, the temperature of the cooling stage may be from about 100° C. to about 50° C., in embodiments from about 98° C. to about 58° C. The spinning speed and diameter of the tube during the cooling phase remain unchanged from the speed, length and diameter of the tube utilized for coalescence.

The particles may be subjected to additional surface treatments by adjusting the slurry pH with the addition of a base solution through inlet port 70. Suitable bases which may be added include, but are not limited to, sodium hydroxide, potassium hydroxide, cesium hydroxide, calcium hydroxide, or any other alkaline base or combinations thereof. Inline pH meter 72 provides feedback to ensure the correct rate of addition of the base. A suitable pH at this stage may be from about 8 to about 11, in embodiments from about 8.8 to about 10.

After the final temperature target of the slurry has been met, which may be from about 25° C. to about 55° C., in embodiments from about 30° C. to about 35° C., aggregation/coalescence is complete and the particle slurry may exit the RTR through outlet 76 and proceed to downstream processing, including washing.

The resulting coalesced toner particles may have varying morphologies, from irregular popcorn-shaped particles to smooth spherical particles. The diameter of the resulting coalesced particles may be from about 1 micron to about 20 microns, in embodiments from about 3 microns to about 15 microns.

Any monomer suitable for preparing a latex emulsion can be used in the present processes. Suitable monomers useful in forming the latex emulsion, and thus the resulting latex particles in the latex emulsion include, but are not limited to, styrenes, acrylates, methacrylates, butadienes, isoprenes, acrylic acids, methacrylic acids, acrylonitriles, mixtures thereof, and the like. Any seed resin employed may be selected depending upon the particular latex polymer to be made in the emulsion polymerization process. In embodiments, the optional seed resin includes the latex particles being produced.

In embodiments, the resin of the latex may include at least one polymer. In embodiments, at least one is from about one to about twenty and, in embodiments, from about three to about ten. Exemplary polymers includes styrene acrylates, styrene butadienes, styrene methacrylates, and more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and mixtures thereof The polymer may be block, random, or alternating copolymers. In addition, polyester resins obtained from the reaction of bisphenol A and propylene oxide or propylene carbonate, and in particular including such polyesters followed by the reaction of the resulting product with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol may also be used.

In embodiments, an amorphous polyester resin, for example a polypropoxylated bisphenol A fumarate polyester, may be prepared in the continuous process of the present disclosure and then utilized to form a toner composition. Bisphenol A, propylene oxide or propylene carbonate and fumaric acid would be utilized as monomeric components in the process of the present disclosure while a propoxylated bisphenol A fumarate may be utilized as a seed resin to facilitate formation of the latex. A linear propoxylated bisphenol A fumarate resin which may be utilized as a seed resin is available under the trade name SPARII from Resana S/A Industrias Quimicas, Sao Paulo Brazil. Other propoxylated bisphenol a fumarate resins that are commercially available include GTUF and FPESL-2 from Kao Corporation, Japan, and EM181635 from Reichhold, Research Triangle Park, North Carolina and the like.

Examples of initiators which may be added in preparing the latex include water soluble initiators, such as ammonium and potassium persulfates, and organic soluble initiators including peroxides and hydroperoxides including Vazo peroxides, such as VAZO 64™, 2-methyl 2-2'-azobis propanenitrile, VAZO 88™, and 2-2'-azobis isobutyramide dehydrate and mixtures thereof. In embodiments chain transfer agents may be utilized including dodecane thiol, octane thiol, carbon tetrabromide, mixtures thereof, and the like. The amount of initiator can be from about 0.1 to about 8 percent by weight of the final emulsion composition, in embodiments from about 2 to about 6 percent by weight of the final emulsion composition.

Surfactants which may be utilized in preparing latexes with the processes of the present disclosure include ionic and/or nonionic surfactants. Anionic surfactants which may be utilized include sulfates and sulfonates, sodium dodecylsulfate (SDS), sodium dodecylbenzene sulfonate, sodium dodecyinaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, mixtures thereof, and the like.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, mixtures thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be selected.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, and the like, and mixtures thereof. The choice of particular surfactants or combinations thereof as well as the amounts of each to be used are within the purview of those skilled in the art.

In embodiments, the latex of the present disclosure may be combined with a colorant to produce a toner by processes within the purview of those skilled in the art. Colorants include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB530™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, CI 12466, also known as Pigment Red 269, CI 12516, also known as Pigment Red 185, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, CI Pigment Yellow 74, a nitrophenyl amine sulfonamide identified in the Color Index as Foron Yellow SE/GLN, CI Dispersed Yellow 33,2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 20 weight percent of the toner.

Wax dispersions may also be added to toners of the present disclosure. Suitable waxes include, for example, submicron wax particles in the size range of from about 50 to about 500 nanometers, in embodiments of from about 100 to about 400 nanometers in volume average diameter, suspended in an aqueous phase of water and an ionic surfactant, nonionic surfactant, or mixtures thereof. The ionic surfactant or nonionic surfactant may be present in an amount of from about 0.5 to about 10 percent by weight, and in embodiments of from about 1 to about 5 percent by weight of the wax.

The wax dispersion according to embodiments of the present disclosure includes a wax for example, a natural vegetable wax, natural animal wax, mineral wax and/or synthetic wax. Examples of natural vegetable waxes include, for example, canauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., Viscol 550-P, a low weight average molecular weight polypropylene available from Sanyo Kasel K.K., and similar materials. In embodiments, commercially available polyethylene waxes possess a molecular weight (Mw) of from about 1,000 to about 1,500, and in embodiments of from about 1,250 to about 1,400, while the commercially available polypropylene waxes have a molecular weight of from about 4,000 to about 5,000, and in embodiments of from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight, and in embodiments from about 2 to about 20 percent by weight of the toner.

In some embodiments silica may be added. Silica may be added for denaturing the coagulants utilized with certain colors, but is not used for every toner.

In embodiments, two or more of the water, surfactant, monomer, seed resin coagulants, silica (if any), wax, and the like may be pre-mixed prior to introduction into the reactor. For example, a surfactant may be pre-mixed with monomer and introduced into an SDR or an RTR. As another example, a seed resin may be pre-mixed with surfactant and introduced into the SDR or RTR simultaneously with the monomer. Any other suitable combinations may be utilized. Additionally, at least one monomer may be utilized in forming the resin; in embodiments from about 2 to about 10 monomers may be utilized.

In embodiments, a latex which may be utilized includes, for example, resin particles in the size range of, for example, from about 50 nanometers to about 800 nanometers and, in embodiments from about 200 nanometers to about 240 nanometers in volume average diameter as determined, for example, by a Brookhaven nanosize particle analyzer. The resin is generally present in the toner composition of from about 75 weight percent to about 98 weight percent, and in embodiments from about 80 weight percent to about 95 weight percent of the toner or the solids of the toner. The expression solids can refer, in embodiments, to the latex, colorant, wax, and any other optional additives of the toner composition.

The latex may be added to a colorant dispersion and optionally a wax dispersion. The colorant dispersion includes, for example, submicron colorant particles in the size range of, for example, from about 50 to about 500 nanometers and in embodiments, of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and is from about 1 to about 25 percent by weight, and in embodiments from about 4 to about 15 percent by weight of the colorant.

The pH of the mixture is then lowered to from about 3.5 to about 6 and in embodiments, to from about 3.7 to about 5.5 with, for example, an acid to coalesce the toner aggregates. Suitable acids include, for example, nitric acid, sulfuric acid, hydrochloric acid, citric acid or acetic acid. The amount of acid added may be from about 4 to about 30 percent by weight of the mixture, and in embodiments from about 5 to about 15 percent by weight of the mixture.

The mixture is cooled, washed and dried. Cooling may be at a temperature of from about 20° C. to about 50° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 60° C. to about 20° C., and in embodiments of from about 30° C. to about 22° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture is not feasible nor practical, neither by the introduction of a cooling medium into the toner mixture, nor by the use of jacketed reactor cooling.

The washing may be carried out at a pH of from about 7 to about 12, and in embodiments at a pH of from about 9 to about 11. The washing is at a temperature of from about 45° C. to about 70° C., and in embodiments from about 50° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

The particle size of the resulting toner may be from about 1 micron to about 20 microns, in embodiments from about 3 microns to about 15 microns.

Any aggregating agent capable of causing complexation might be used in forming toner of the present disclosure. Both alkali earth metal or transition metal salts can be utilized as aggregating agents. In embodiments, alkali (II) salts can be selected to aggregate sodio sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally mixtures thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, mixtures thereof, and the like.

Stabilizers that may be utilized in the present continuous processes include bases such as metal hydroxides, including sodium hydroxide, potassium hydroxide, ammonium hydroxide, and optionally mixtures thereof. Also useful as a stabilizer is a composition containing sodium silicate dissolved in sodium hydroxide.

In order to aid in the processing of the toner composition, an ionic coagulant having an opposite polarity to the ionic surfactant in the latex (i.e., a counterionic coagulant) may optionally be used in the toner composition. The quantity of coagulant is present to, for example, prevent/minimize the appearance of fines in the final slurry. Fines refers, in embodiments, for example, to small sized particles of less than about 6 microns in average volume diameter, in embodiments from about 2 microns to about 5 microns in average volume diameter, which fines can adversely affect toner yield. Counterionic coagulants may be organic or inorganic entities. Exemplary coagulants that can be included in the toner include polymetal halides, polymetal sulfosilicates, monovalent, divalent or multivalent salts optionally in combination with cationic surfactants, mixtures thereof, and the like. Inorganic cationic coagulants include, for example, polyaluminum chloride (PAC), polyaluminum sulfo silicate (PASS), aluminum sulfate, zinc sulfate, or magnesium sulfate. For example, in embodiments the ionic surfactant of the resin latex dispersion can be an anionic surfactant, and the counterionic coagulant can be a polymetal halide or a polymetal sulfo silicate. When present, the coagulant is used in an amount from about 0.02 to about 2 percent by weight of the total toner composition, in embodiments from about 0.1 to about 1.5 percent by weight of the total toner composition.

The toner may also include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Example of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

Toner in accordance with the present disclosure can be used in a variety of imaging devices including printers, copy machines, and the like. The toners generated in accordance with the present disclosure are excellent for imaging processes, especially xerographic processes and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Imaging methods are also envisioned with the toners disclosed herein. Such methods include, for example, some of the above patents mentioned above and U.S. Pat. Nos. 4,265,990, 4,858,884, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

Advantages of the continuous processes of the present disclosure include: (1) it is less labor intense; (2) it allows for more precise process control and product quality control; (3) it allows for easy scale-out rather than scale-up, since it does not require large quantities of material necessary for conventional reactor processes; (4) it is more energy efficient and produces less waste; (5) it is simple and can reduce the capital investment required to prepare latex as well as the lead times for commercialization; (6) it can increase productivity and reduce Unit Manufacturing Cost (UMC); (7) it is able to provide different types of particles having varying compositions and morphologies; (8) it can reduce the time necessary to produce the latex; and (9) it may, in embodiments, allow for in situ emulsifying polyester without solvent.

Continuous processing using a combination of SDRs and tubular reactors allows for easier control and safer handling because bulk quantities of material are not being handled in a batch process. Tighter control of particle properties is possible because of the intrinsic ability of these reactors to provide a consistent environment, for example process temperature, shear, and residence time for the material being processed.

The following example illustrates embodiments of the present disclosure. The example is intended to be illustrative only and is not intended to limit the scope of the present disclosure. Also, parts and percentages are by weight unless otherwise indicated.

EXAMPLES

Example 1

Raw materials a pre-blend of about 2.7% 0.02M HNO3, about 24.3% latex core including a styrene/n-butyl acrylate/β-carboxyethyl acrylate copolymer of 74:23:3, about 11.6% latex shell including a styrene/n-butyl acrylate/β-carboxyethyl acrylate copolymer of 74:23:3, about 4.1% Regal 330 Carbon Black Pigment, 5.1% Wax dispersion, and about 51.8% deionized water are mixed in a concave bottom stirred vessel and homogenized. This homogenized raw material mixture is then fed into a rotating tubular reactor at a rate of about 0.5 ml/sec to about 3 ml/sec rate and the RTR is spun at about 500 rpm to about 10000 rpm depending on size requirements for aggregation.

Once the material reaches the desired size of about 3 um to about 6 um, it is introduced into a spinning disc reactor such as a Protensive 30 cm SDR, at a rate of about 0.5 ml/sec to about 3 ml/sec rate. About 0.1 ml to about 0.8 ml of the shell latex is added to provide toner with a core—shell structure. A residence time of about 0.05 seconds to about 3 seconds is utilized and the resulting aggregated toner has a size of about 5 um to about 8 um in diameter. A pH probe is utilized at the collection point to determine the pH of the toner particles and NaOH is added until the slurry reaches a desired pH of about 4 to about 8.

The aggregated particles are then introduced into another RTR at a temperature of about 96° C. for coalescence. A pH probe in the RTR at this stage monitors the pH so that acid or base can be added to adjust initial pH as desired to about 3 to about 7. The residence time in the coalescence stage of the RTR may be adjusted from about 1 second to about 10 seconds, depending upon the desired particle shape. After coalescence, the particles proceed into the cooling stage of the RTR, where they are cooled to about 56° C. to about 66° C. A pH probe at the end of the cooling stage monitors the pH of the particles and sodium hydroxide is added to adjust the pH from about 8.8 to about 10.5. The particles then exit the RTR where they are cooled to room temperature, after which they may be washed and dried before use.

Example 2

Raw materials (a pre-blend of about 1.6% 0.02M HNO3, about 19.2% latex core including a styrene/n-butyl acrylate/β-carboxyethyl acrylate copolymer of 74:23:3, about 10.7% latex shell including a styrene/n-butyl acrylate/β-carboxyethyl acrylate copolymer of 74:23:3, about 6.2% PR122 Red pigment, about 1.6% PR185 Red pigment, 4.6% Wax dispersion, and about 51.4% deionized water) are mixed in a concave bottom stirred vessel and homogenized. This homogenized raw material mixture is then introduced into a spinning disc reactor such as a Protensive 30 cm SDR at a rate of about 0.5 ml/second to about 3 ml/second rate and the SDR is spun at about 500 rpm to about 10000 rpm depending on size requirements for aggregation.

Once the material reaches the desired size of about 3 um to about 6 um, it is introduced into a second SDR at a rate of about 0.5 ml/second to about 3 ml/second rate. About 0.1 ml to about 0.8 ml of the shell latex is added to provide toner with a core shell structure. A residence time of about 0.05 seconds to about 3 seconds is utilized and the resulting aggregated toner has a size of about 5 um to about 8 um in diameter. A pH probe is utilized at the collection point to determine the pH of the toner particles and NaOH is added until the slurry reaches a desired pH of about 4 to about 8.

The aggregated particles are then introduced into an RTR at a temperature of about 96° C. for coalescence. A pH probe in the RTR at this stage monitors the pH so that acid or base can be added to adjust initial pH as desired to about 5.5 to about 6.0. The residence time in the coalescence stage of the RTR may be adjusted from about 1 second to about 5 seconds, depending upon the desired particle shape. After coalescence, the particles proceed into the cooling stage of the RTR, where they are cooled to about 56° C. to about 66° C. A pH probe at the end of the cooling stage monitors the pH of the particles and sodium hydroxide is added to adjust the pH from about 8.8 to about 10.5. The particles then exit the RTR where they are cooled to room temperature, after which they may be washed and dried before use.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process for continuously producing toner comprising:

continuously aggregating a colorant and latex emulsion in an aggregation component of a reaction system at a temperature from about 35° C. to about 75° C. and a pH from about 3.5 to about 7 to form aggregated toner particles;

continuously coalescing the aggregated toner particles in a coalescence component of the reaction system to form aggregated and coalesced toner particles; and collecting the aggregated and coalesced toner particles from the reaction system, wherein the reaction system comprises a spinning disc reactor, a rotating tubular reactor or combinations thereof.

2. A process as in claim 1, wherein the colorant and latex emulsion in the aggregation component of the reaction system are, and the aggregated toner particles in the coalescence component of the reaction system are at a temperature from about 80° C. to about 100° C. and a pH from about 3 to about 7, optionally further comprising cooling the aggregated and coalesced toner particles to a temperature from about 60° C. to about 20° C., and optionally further comprising washing said aggregated and coalesced toner particles at a temperature from about 45° C. to about 70° C. and a pH from about 7 to about 12.

3. A process as in claim 1, wherein the colorant and latex emulsion in the aggregation component of the reaction system are at a temperature from about 45° C. to about 65° C. and a pH from about 4.5 to about 6, and the aggregated toner particles in the coalescence component of the reaction system are at a temperature from about 93° C. to about 97° C. and a pH from about 4 to about 6, optionally further comprising cooling the aggregated and coalesced toner particles to a temperature from about 98° C. to about 58° C., and optionally further comprising washing said aggregated and coalesced toner particles at a temperature from about 50° C. to about 67° C. and a pH from about 9 to about 11.

4. A process as in claim 1, wherein the latex emulsion comprises latex particles selected from the group consisting of styrenes, acrylates, methacrylates, butadienes, isoprenes, acrylic acids, methacrylic acids, acrylonitriles, and optionally mixtures thereof, and particles comprising the aggregated and coalesced toner particles have a diameter from about 1 microns to about 20 microns.

5. A process as in claim 1, wherein the latex emulsion comprises latex particles selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly (styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), and poly(acrylonitrile-butyl acrylate-acrylic acid), and particles comprising the aggregated and coalesced toner particles have a diameter from about 3 microns to about 15 microns.

6. A process as in claim 1, wherein the colorant is selected from the group consisting of black pigments, cyan pigments, magenta pigments, red pigments, brown pigments, orange pigments yellow pigments, and mixtures thereof.

7. A process as in claim 1, wherein the colorant is selected from the group consisting of carbon black, 2,9-dimethyl-substituted quinacridone and anthraquinone dye, diazo dye, copper tetra(octadecyl sulfonamido) phthalocyanine, x-copper phthalocyanine pigment, anthrathrene blue, diarylide yellow 3,3-dichlorobenzidene acetoacetanilide, nitrophenyl amine sulfonamide, and 2,5-dimethoxy-4-sulfonanilide phenylazo-4'-chloro-2,5-dimethoxy acetoacetanilide and mixtures thereof.

8. A process as in claim 1, further comprising adding an aggregating agent selected from the group consisting of alkali earth metal salts and transition metal salts to the latex in the aggregation component of the reaction system, and optionally adding a metal hydroxide stabilizer selected from the group consisting of sodium hydroxide, potassium hydroxide, ammonium hydroxide, sodium silicate dissolved in sodium hydroxide, and mixtures thereof to the aggregated toner particles in the coalescence component of the reaction system.

9. A process as in claim 8, wherein the aggregating agent is selected from the group consisting of beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, vanadium acetate, niobium acetate, tantalum acetate, chromium acetate, molybdenum acetate, tungsten acetate, manganese acetate, iron acetate, ruthenium acetate, cobalt acetate, nickel acetate, copper acetate, zinc acetate, cadmium acetate, silver acetate, vanadium acetoacetate, niobium acetoacetate, tantalum acetoacetate, chromium acetoacetate, molybdenum acetoacetate, tungsten acetoacetate, manganese acetoacetate, iron acetoacetate, ruthenium acetoacetate, cobalt acetoacetate, nickel acetoacetate, copper acetoacetate, zinc acetoacetate, cadmium acetoacetate, silver acetoacetate, vanadium sulfate, niobium sulfate, tantalum sulfate, chromium sulfate, molybdenum sulfate, tungsten sulfate, manganese sulfate, iron sulfate, ruthenium sulfate, cobalt sulfate, nickel sulfate, copper sulfate, zinc sulfate, cadmium sulfate, silver sulfate, aluminum acetate, polyaluminum chloride, and mixtures thereof.

10. A process as in claim 1, wherein the aggregation component of the reaction system comprises at least one spinning disc reactor and the coalescence component of the reaction system comprises a rotating tubular reactor.

11. A process as in claim 1, wherein aggregation component of the reaction system comprises from about 2 to about 10 spinning disc reactors.

12. A process as in claim 1, wherein the aggregation component of the reaction system comprises a spinning disc reactor and a rotating tubular reactor.

13. A process for continuously producing toner in a reaction system comprising:

continuously aggregating a colorant selected from the group consisting of black pigments, cyan pigments, magenta pigments, red pigments, brown pigments, orange pigments yellow pigments, and mixtures thereof and a latex emulsion comprising latex particles selected from the group consisting of styrenes, acrylates, methacrylates, butadienes, isoprenes, acrylic acids, methacrylic acids, acrylonitriles, and optionally mixtures thereof in a first reactor comprising a spinning disc reactor at a temperature from about 35° C. to about 75° C. and a pH from about 3.5 to about 7 to form aggregated toner particles;

continuously coalescing the aggregated toner particles in a second reactor comprising a rotating tubular reactor at a temperature from about 80° C. to about 100° C. and a pH from about 3 to about 7 to form aggregated and coalesced toner particles having a diameter from about 1 micron to about 20 microns;

optionally further comprising cooling the aggregated and coalesced toner particles to a temperature from about 60° C. to about 20° C.; and collecting the aggregated and coalesced toner particles from the reaction system.

14. The process of claim 13, wherein the first reactor comprises a spinning disc reactor optionally in combination with a rotating tubular reactor, the colorant is selected from the group consisting of carbon black, 2,9-dimethyl-substituted quinacridone and anthraquinone dye, diazo dye, copper tetra (octadecyl sulfonamido) phthalocyanine, x-copper phthalocyanine pigment, anthrathrene blue, diarylide yellow 3,3-dichlorobenzidene acetoacetanilide, nitrophenyl amine sulfonamide, and 2,5-dimethoxy-4-sulfonanilide phenylazo-4'-chloro-2,5-dimethoxy acetoacetanilide and mixtures thereof, the latex comprises latex particles selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl metbacrylate-butyl acrylate), poly(butyl methacrylate-acrylic acid), poly(styrene-butyl acrylate-acrylonitrile-acrylic acid), and poly(acrylonitrile-butyl acrylate-acrylic acid), aggregating the colorant and the latex emulsion occurs at a temperature from about 45° C. to about 65° C. and a pH from about 4.5 to about 6, coalescing the aggregated toner particles occurs at a temperature from about 93° C. to about 97° C. and a pH from about 4 to about 6, and particles comprising the aggregated and coalesced toner particles have a diameter from about 3 microns to about 15 microns.

* * * * *